US007598664B2

(12) United States Patent
Miyata et al.

(10) Patent No.: US 7,598,664 B2
(45) Date of Patent: Oct. 6, 2009

(54) GAS DISCHARGE DISPLAY APPARATUS

(75) Inventors: Takashi Miyata, Yamanashi (JP); Tetsuya Matsumoto, Yamanashi (JP); Yukihiko Sugio, Yamanashi (JP); Yoshihiko Kamo, Yamanashi (JP)

(73) Assignee: Panasonic Corporation, Osaka (JP)

( * ) Notice: Subject to any disclaimer, the term of this patent is extended or adjusted under 35 U.S.C. 154(b) by 371 days.

(21) Appl. No.: 11/727,679

(22) Filed: Mar. 28, 2007

(65) Prior Publication Data

US 2007/0228980 A1 Oct. 4, 2007

(30) Foreign Application Priority Data

Mar. 29, 2006 (JP) ..... 2006-092054

(51) Int. Cl.
*H01J 1/62* (2006.01)

(52) U.S. Cl. ..... 313/487; 313/484

(58) Field of Classification Search ..... 313/484–487
See application file for complete search history.

(56) References Cited

U.S. PATENT DOCUMENTS

2004/0090169 A1 5/2004 Choi
2005/0264206 A1 12/2005 Yoshinari et al.

FOREIGN PATENT DOCUMENTS

| | | |
|---|---|---|
| EP | 1 517 349 A2 | 3/2005 |
| EP | 1 536 448 A1 | 6/2005 |
| EP | 1 612 193 A1 | 1/2006 |
| EP | 1 638 127 A2 | 3/2006 |

OTHER PUBLICATIONS

Akio Nishida et al.; "Preparation and Properties of Magnesia Powder"; Vapor Phase Oxidation Process; Journal of The Society of Materials Science; Nov. 1987; pp. 1157-1161; vol. 36; No. 410; Japan.

*Primary Examiner*—Vip Patel
(74) *Attorney, Agent, or Firm*—Arent Fox LLP

(57) ABSTRACT

In a gas discharge display apparatus, a dielectric layer overlies the row electrode pairs provided between the opposing front and back glass substrates placed across the discharge space. A protective layer for the dielectric layer includes a crystalline MgO layer that has a property causing a cathode-luminescence emission having a peak within a wavelength range of 200 nm to 300 nm upon excitation by electron beams. A red phosphor layer generating visible light by being excited by vacuum ultraviolet light includes a mixed phosphor of a first phosphor of (Y, Gd)$BO_3$:Eu or the like which is a borate-system red phosphor and a second phosphor of Y(V, P)$O_4$:Eu which is a phos-vana system red phosphor.

11 Claims, 13 Drawing Sheets

SECTION V-V

*EMBODIMENT*

SECTION V-V

SECTION W-W

SINGLE CRYSTAL OF CUBIC SINGLE-CRYSTAL STRUCTURE

SINGLE CRYSTALLINE MgO OF CUBIC POLYCRYSTAL STRUCTURE

α: WITH CRYSTALLINE MgO LAYER, WITH MIXED RED PHOSPHOR

β: WITH CRYSTALLINE MgO LAYER, WITH CONVENTIONAL RED PHOSPHOR

γ: WITHOUT CRYSTALLINE MgO LAYER, WITH CONVENTIONAL RED PHOSPHOR m : CONVENTIONAL RED PHOSPHOR LAYER
($(Y,Gd)BO_3$ : Eu)

n : MIXED RED PHOSPHOR LAYER
($(Y,Gd)BO_3$ : Eu 50% + $Y(V,P)O_4$ : Eu 50%)

VOLTAGE DRIFT

| ACCELERATION TIME | CONVENTIONAL RED PHOSPHOR LAYER(m) | MIXED RED PHOSPHOR LAYER(n) |
|---|---|---|
| 0 | 0 | 0 |
| 25 | 30 | 15 |
| 60 | 75 | 45 |
| 100 | 100 | 50 |

m : CONVENTIONAL RED PHOSPHOR LAYER ($(Y,Gd)BO_3$ : Eu)

n : MIXED RED PHOSPHOR LAYER ($(Y,Gd)BO_3$ : Eu 50% + $Y(V,P)O_4$ : Eu 50%)

LUMINANCE DRIFT

| ACCELERATION TIME | CONVENTIONAL RED PHOSPHOR LAYER(m) | MIXED RED PHOSPHOR LAYER(n) |
|---|---|---|
| 0 | 100 | 100 |
| 25 | 98 | 100 |
| 60 | 92 | 95 |
| 100 | 84 | 91 |

m : CONVENTIONAL RED PHOSPHOR LAYER ($(Y,Gd)BO_3$ : Eu)

n : MIXED RED PHOSPHOR LAYER ($(Y,Gd)BO_3$ : Eu 50% + $Y(V,P)O_4$ : Eu 50%)

VOLTAGE RESIDUAL IMAGE

| ACCELERATION TIME | CONVENTIONAL RED PHOSPHOR LAYER(m) | MIXED RED PHOSPHOR LAYER(n) |
|---|---|---|
| 0 | 10 | 10 |
| 100 | 40 | 20 |

GAS DISCHARGE DISPLAY APPARATUS

BACKGROUND OF THE INVENTION

1. Field of the Invention

This invention relates to a gas discharge display apparatus having a phosphor layer which generates visible light upon excitation by vacuum ultraviolet light.

The present application claims priority from Japanese Applications No. 2006-092054, the disclosure of which is incorporated herein by reference.

2. Description of the Related Art

Typically, a surface-discharge-type alternating-current plasma display panel (hereinafter referred to as "PDP"), which is of a gas discharge display apparatus, includes two opposing glass substrates placed on either side of a discharge space. On one of the two glass substrates a plurality of row electrode pairs, which extend in the row direction, are regularly arranged in the column direction and covered by a dielectric layer. On the dielectric layer a protective layer formed of magnesium oxide which is formed by a vapor deposition technique. On the other glass substrate, a plurality of column electrodes extending in the column direction are regularly arranged in the row direction, thus forming discharge cells arranged in the matrix form in positions corresponding to the intersections between the row electrode pairs and the column electrodes in the discharge space.

Phosphor layers, to which the primary colors, red, green and blue are applied, are formed in the respective discharge cells. Conventionally, $(Y, Gd)BO_3$:Eu is known as a red phosphor, $(Ba, Sr, Ca)MgAl_{10}O_{17}$:Mn as a green phosphor, and $BaMgAl_{10}O_{17}$:Eu as a blue phosphor.

The discharge space of the PDP is filled with a discharge gas consisting of a gas mixture of neon and xenon.

The PDP initiates a reset discharge simultaneously between the row electrodes in each row electrode pair, and then an address discharge selectively between one of the row electrodes and the column electrode. The address discharge results in the distribution, over the panel surface, of light-emitting cells having the deposition of the wall charge on the dielectric layer adjoining each discharge cell, and no-light-emitting cells in which the wall charge has been erased from the dielectric layer. Then, a sustaining discharge is produced between the row electrodes of the row electrode pairs in the light-emitting cells. The sustaining discharge results in the emission of vacuum ultraviolet light from the xenon included in the discharge gas filling the discharge space. The vacuum ultraviolet light in turn excites the phosphor layer, whereupon the red, green and blue phosphor layers emit visible light to generate a matrix-display image on the panel surface.

In a PDP of such a structure, the protective layer formed of magnesium oxide and deposited on the dielectric layer overlying the row electrode pairs has the function of protecting the dielectric layer from ion impact and the function of emitting secondary electrons into the discharge space.

For this reason, in the conventional PDP provided with a protective layer having a high degree of the secondary-electron emission function for the purpose of a reduction in discharge voltage, when the application of a sustaining pulse causes a sustaining discharge in a lot of the light-emitting cells at approximately the same time, a large amount of electric current flows momentarily, thus increasing the discharge intensity. As a result, the luminance voltage residual image increases, and also degradation in the display quality, such as a reduction in the panel life, may possibly be caused.

It is a technical object of the present invention to solve the problems associated with the conventional gas discharge display apparatus as described above.

SUMMARY OF THE INVENTION

To attain the above object, the present invention provides a gas discharge display apparatus that has: a pair of substrates facing each other across a discharge space; row electrode pairs and column electrodes which are placed between the pair of substrates, each row electrode pair and each column electrode being positioned at distance from each other and extending in directions at right angles to each other to form unit light emission areas in positions corresponding to the intersections in the discharge space; a dielectric layer overlying the row electrode pairs; a protective layer overlying the dielectric layer and facing the unit light emission areas; and red, green and blue colored phosphor layers that generate visible light by being excited by vacuum ultraviolet light, the discharge space being filled with a discharge gas. The gas discharge display apparatus is characterized in that the protective layer includes a magnesium oxide crystal that have a crystalline structure causing a cathode-luminescence emission having a peak within a wavelength range of 200 nm to 300 nm upon excitation by electron beams, and that at least one phosphor layer of the red, green and blue colored phosphor layers includes a phosphor made by mixing together a first phosphor and a second phosphor generating lower amounts of reduction gas and carbonization gas than that generated by the first phosphor.

In a gas discharge display apparatus according to a best mode for carrying out the present invention, the protective layer for the dielectric layer which overlies the row electrode pairs provided between a pair of substrates facing each other across the discharge space includes a magnesium oxide crystal that have a crystalline structure causing a cathode-luminescence emission having a peak within a wavelength range of 200 nm to 300 nm upon excitation by electron beams, and at least one phosphor layer of the red, green and blue colored phosphor layers which generate visible light by being excited by vacuum ultraviolet light, for example, the red phosphor layer, includes a mixed phosphor made by combining a first phosphor of, for example, $(Y, Gd)BO_3$:Eu or the like which is a borate-system red phosphor and a second phosphor of, for example, $Y(V, P)O_4$:Eu or the like of a phos-vana system red phosphor, which generates lower amounts of reduction gas and carbonization gas than the first phosphor.

The gas discharge display apparatus according to the best mode has, for example, a red phosphor player of the phosphor layers formed of a mixed phosphor made by combining the first phosphor and the second phosphor generating lower amounts of reduction gas ($H_2O$ gas) and carbonization gas (CO gas) than the first phosphor. Thereby, even when the protective layer covering the dielectric layer of the gas discharge display apparatus includes an MgO crystal of a high degree of the secondary-electron-emission function, the amount of gas generated when the phosphor layer is excited by the vacuum ultraviolet light, in particular, the amounts of carbonization gas (CO gas) and reduction gas ($H_2O$ gas), are reduced as compared with that in the case of a conventional red phosphor layer. Thus, the effects on the magnesium oxide forming the protective layer are minimized so as to maintain the $\gamma$ characteristics of the panel. In consequence, it is possible to improve the luminance voltage residual-image characteristics of the gas discharge display apparatus to a significantly higher level than heretofore.

In the gas discharge display apparatus of the above mode, the mixed phosphor included in the red phosphor layer preferably includes 20 wt % to 80 wt % of the second phosphor.

When the first phosphor and the second phosphor are mixed at this ratio, a further improvement in the luminance voltage residual-image characteristics of the gas discharge display apparatus becomes possible.

In the gas discharge display apparatus of the above mode, the protective layer preferably comprises a thin-film magnesium oxide layer deposited by vapor deposition or by sputtering, and a crystalline magnesium oxide layer including a magnesium oxide crystal and deposited and laminated on the thin-film magnesium oxide layer. In consequence, a further improvement in the discharge delay characteristics of the gas discharge display apparatus is achieved.

In the gas discharge display apparatus of the above mode, the magnesium oxide crystal is preferably a magnesium oxide single-crystal produced by a vapor-phase oxidization technique, thus further improving the discharge delay characteristics of the gas discharge display apparatus.

In the gas discharge display apparatus of the above mode, the magnesium oxide crystal is preferably a crystal causing a cathode-luminescence emission having a peak within a wavelength range of 230 nm to 250 nm. Thereby, the discharge delay characteristics of the gas discharge display apparatus are further improved.

In the gas discharge display apparatus of the above mode, the magnesium oxide crystal has preferably a particle diameter of 2000 or more angstroms, leading to a further improvement in the discharge delay characteristics of the gas discharge display apparatus.

In the gas discharge display apparatus of the above mode, the discharge gas preferably includes 10% or more xenon by volume, thereby improving the light-emission efficiency of the gas discharge display apparatus.

In the gas discharge display apparatus of the above mode, the dielectric layer covering the row electrode pairs preferably includes a leadless glass material having a relative dielectric constant of 8 or less. Thereby, a further improvement in the luminance voltage residual-image characteristics and the panel life of the gas discharge display apparatus is achieved.

These and other objects and features of the present invention will become more apparent from the following detailed description with reference to the accompanying drawings.

DETAILED DESCRIPTION OF THE PREFERRED EMBODIMENT

Figure 1:
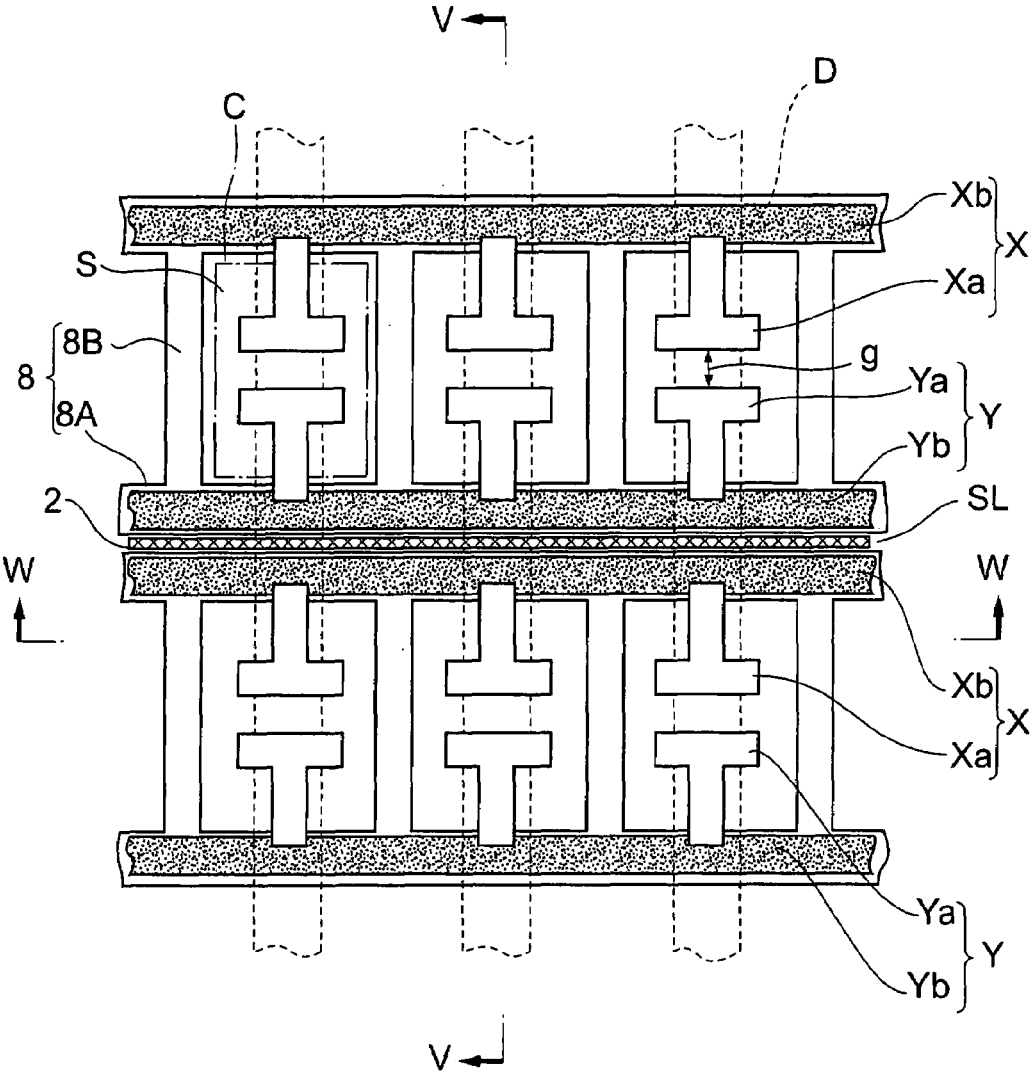
FIG. 1 is a front view illustrating an example of an embodiment according to the present invention.
Figure 2:
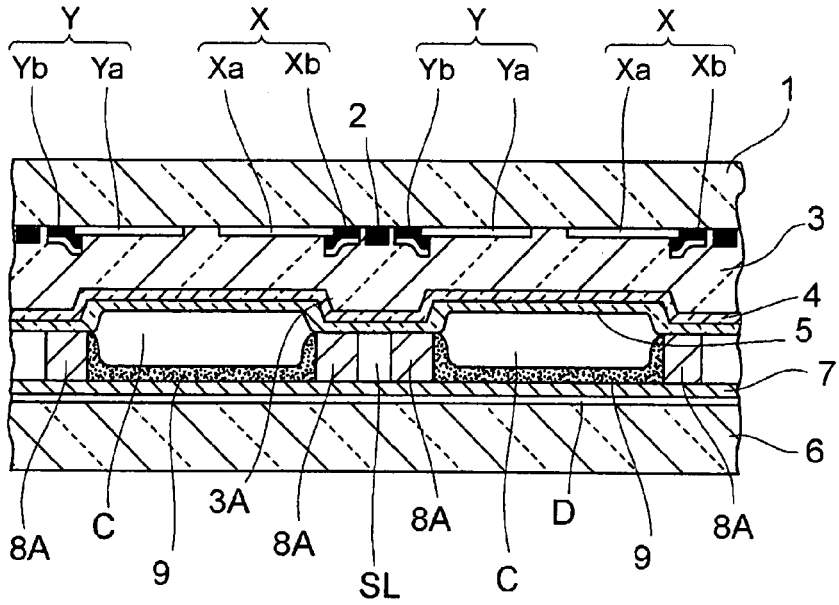
FIG. 2 is a sectional view taken along the V-V line in FIG. 1.
Figure 3:
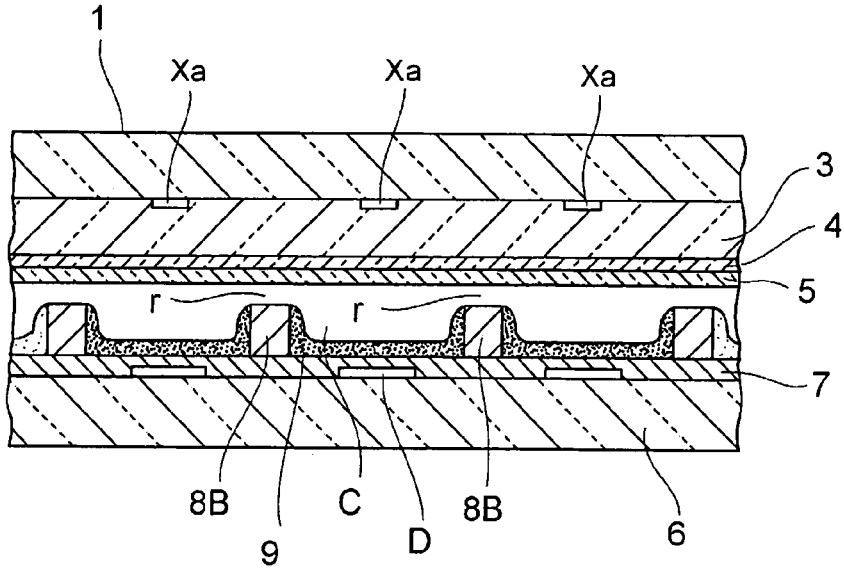
FIG. 3 is a sectional view taken along the W-W line in FIG. 1.

FIGS. 1 to 3 illustrate an example of an embodiment of the PDP according to the present invention. FIG. 1 is a schematic front view of the PDP in the embodiment example. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) arranged in parallel on the rear-facing face (the face facing toward the rear of the PDP) of a front glass substrate 1 serving as the display surface so as to extend in the row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film extending in the row direction of the front glass substrate 1 and connected to the narrow proximal ends of the transparent electrodes Xa.

Likewise, a row electrode Y is composed of T-shaped transparent electrodes Ya formed of a transparent conductive film made of ITO or the like, and a bus electrode Yb formed of a metal film extending in the row direction of the front glass substrate 1 and connected to the narrow proximal ends of the transparent electrodes Ya.

The row electrodes X and Y are arranged in alternate positions in the column direction of the front glass substrate 1 (the vertical direction in FIG. 1). Each of the transparent electrodes Xa and Ya, which are regularly spaced along the associated bus electrodes Xb and Yb facing each other, extends out toward its counterpart in the row electrode pair, so that the wide distal ends of the transparent electrodes Xa and Ya face each other across a discharge gap g having a required width.

A black- or dark-colored light absorption layer (light-shield layer) 2, which extends in the row direction along the back-to-back bus electrodes Xb, Yb of the adjacent row electrode pairs (X, Y) in the column direction, is formed between these bus electrodes Xb and Yb on the rear-facing face of the front glass substrate 1.

In addition, a dielectric layer 3 is formed on the rear-facing face of the front glass substrate 1 so as to overlie the row electrode pairs (X, Y). The dielectric layer 3 is formed of a leadless glass material with a relative dielectric constant $\in$ of no more than 8 (e.g., a Zn—B—Si glass material with a relative dielectric constant $\in$ of 6.8, such as model number "TS-1000C" produced by Nippon Electric Glass Corporation).

On the rear-facing face of the dielectric layer 3, an additional dielectric layer 3A projecting from the dielectric layer 3 toward the rear of the PDP is formed in a portion facing the back-to-back bus electrodes Xb, Yb of the adjacent row electrode pairs (X, Y) and facing the area between the back-to-back bus electrodes Xb, Yb so as to extend in parallel to these bus electrodes Xb, Yb. The additional dielectric layer 3A is formed of the same material as that of the dielectric layer 3.

On the rear-facing faces of the dielectric layer 3 and the additional dielectric layers 3A, a magnesium oxide layer 4 of a thin film form (hereinafter referred to as "thin-film MgO layer 4") is formed by vapor deposition or by spattering and covers the entire rear-facing faces of the dielectric layer 3 and the additional dielectric layers 3A.

In turn, a magnesium oxide layer 5 including a magnesium oxide crystal (hereinafter referred to as "crystalline MgO layer 5"), as described in detail later, is formed on the rear-facing face of the thin-film MgO layer 4. The magnesium oxide crystal has a crystalline structure causing a cathode-luminescence emission (CL emission) having a peak within a wavelength range of 200 nm to 300 nm (more specifically, of 230 nm to 250 nm, around 235 nm) upon excitation by electron beams.

The crystalline MgO layer 5 is formed on the entire rear-facing face or, for example, a part of the rear-facing face of the thin-film MgO layer 4 that faces the discharge cell, which will be described later. (In the example illustrated in FIGS. 1 to 3, the crystalline MgO layer 5 is formed on the entire rear-facing face of the thin-film MgO layer 4.)

The front glass substrate 1 is placed parallel to a back glass substrate 6. Column electrodes D are arranged parallel to each other at predetermined intervals on the front-facing face (the face facing toward the display surface of the PDP) of the back glass substrate 6. Each of the column electrodes D extends in a direction at right angles to the row electrode pairs (X, Y) (i.e. in the column direction) on a portion of the back glass substrate 6 opposite to the paired transparent electrodes Xa and Ya of each row electrode pair (X, Y).

On the front-facing face of the back glass substrate 6, a white column-electrode protective layer (dielectric layer) 7 overlies the column electrodes D, and in turn partition wall units 8 are formed on the column-electrode protective layer 7.

Each of the partition wall units 8 is formed in an approximate ladder shape made up of a pair of transverse walls 8A and vertical walls 8. The pair of transverse walls 8A extends in the row direction in the respective positions opposite to the bus electrodes Xb and Yb of each row electrode pair (X, Y). Each of the vertical walls 8B extends in the column direction between the pair of transverse walls 8 in a mid-position between the adjacent column electrodes D. The partition wall units 8 are regularly arranged in the column direction in such a manner as to form an interstice SL extending in the row direction between the back-to-back transverse walls 8A of the adjacent partition wall sets 8.

The ladder-shaped partition wall units 8 partition the discharge space S defined between the front glass substrate 1 and the back glass substrate 6 into quadrangular areas to form discharge cells C in positions each corresponding to the paired transparent electrodes Xa and Ya of each row electrode pair (X, Y).

A phosphor layer 9 overlies five faces facing each discharge space S: the four side faces of the transverse walls 8A and the vertical walls 8B of the partition wall unit 8 and the face of the column-electrode protective layer 7. The three primary colors of the phosphor layers 9, red, green and blue, are arranged in order in the row direction on a discharge-cell-C basis.

A Phosphor forming the phosphor layer 9 will be described later in detail.

The crystalline MgO layer 5 (or the thin-film MgO layer 4 when the crystalline MgO layer 5 is formed only on a portion of the rear-facing face of the thin-film MgO layer 4 facing each discharge cell C) overlying the additional dielectric layer 3A (see FIG. 2) is in contact with the front-facing face of each of the transparent walls 8A of the partition wall units 8, to block off the discharge cell C and the interstice SL from each other. However, the crystalline MgO layer 5 is out of contact with the front-facing face of the vertical wall 8B (see FIG. 3), to form a clearance r therebetween, so that the adjacent discharge cells C in the row direction interconnect with each other by means of the clearance r.

The discharge space S is filled with a Ne—Xe discharge gas including no less than 10% xenon by volume.

The red-colored phosphor layer (hereinafter referred to as "red phosphor layer") 9 of the phosphor layers 9 on the above-described PDP is formed of a mixed red phosphor made by combining 80 wt % to 20 wt % of $(Y, Gd)BO_3$:Eu which is a borate-system red phosphor (hereinafter referred to as "first red phosphor") and 20 wt % to 80 wt % of $Y(V, P)O_4$:Eu which is a phos-vana (phosphorus-vanadium) system red phosphor (hereinafter referred to as "second red phosphor").

For the buildup of the crystalline MgO layer 5 of the above PDP, a spraying technique, electrostatic coating technique or the like is used to cause the MgO crystal as described earlier to adhere to the rear-facing face of the thin-film MgO layer 4 overlying the dielectric layer 3 and the additional dielectric layers 3A.

The embodiment example describes the case where the thin-film MgO layer 4 is formed on the rear-facing faces of the dielectric layer 3 and additional dielectric layer 3A and then the crystalline MgO layer 5 is formed on the rear-facing face of the thin-film MgO layer 4. Alternatively, the crystalline MgO layer 5 may be formed first on the rear-facing faces of the dielectric layer 3 and additional dielectric layers 3A and then the thin-film MgO layer 4 may be formed on the rear-facing face of the crystalline MgO layer 5.

Figure 4:
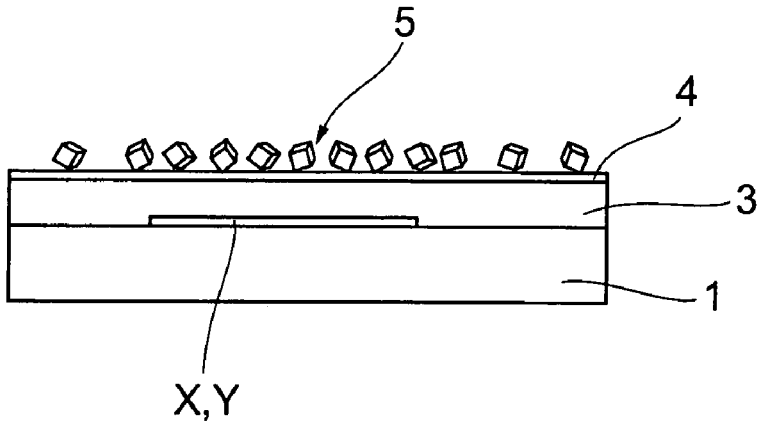
FIG. 4 is a sectional view illustrating a crystalline magnesium layer formed on a thin-film magnesium layer in the embodiment example.

FIG. 4 shows the state when the thin-film MgO layer 4 is formed first on the rear-facing face of the dielectric layer 3 and then the MgO crystal is deposited on the rear-facing face of the thin-film MgO layer 4 to form the crystalline MgO layer 5 by use of a spraying technique, electrostatic coating technique or the like.

Figure 5:
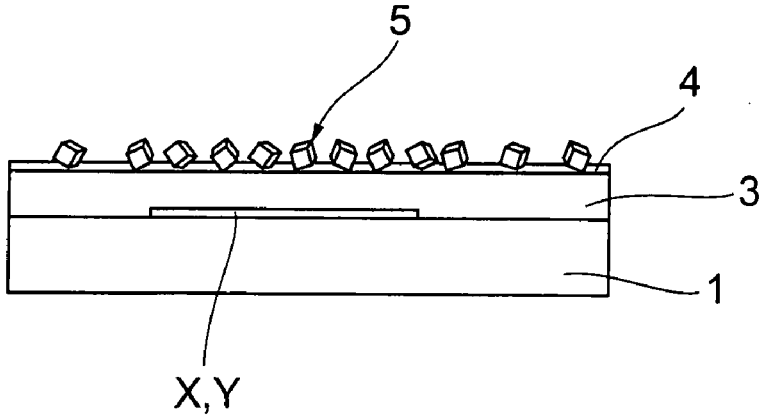
FIG. 5 is a sectional view illustrating a thin-film magnesium layer formed on a crystalline magnesium layer in the embodiment example.

FIG. 5 shows the state when the MgO crystal is affixed to the rear-facing face of the dielectric layer 3 to form the crystalline MgO layer 5 by use of a spraying technique, electrostatic coating technique or the like, and then the thin-film MgO layer 4 is formed after that.

The crystalline MgO layer 5 of the PDP is formed by use of the following materials and method.

Figure 6:
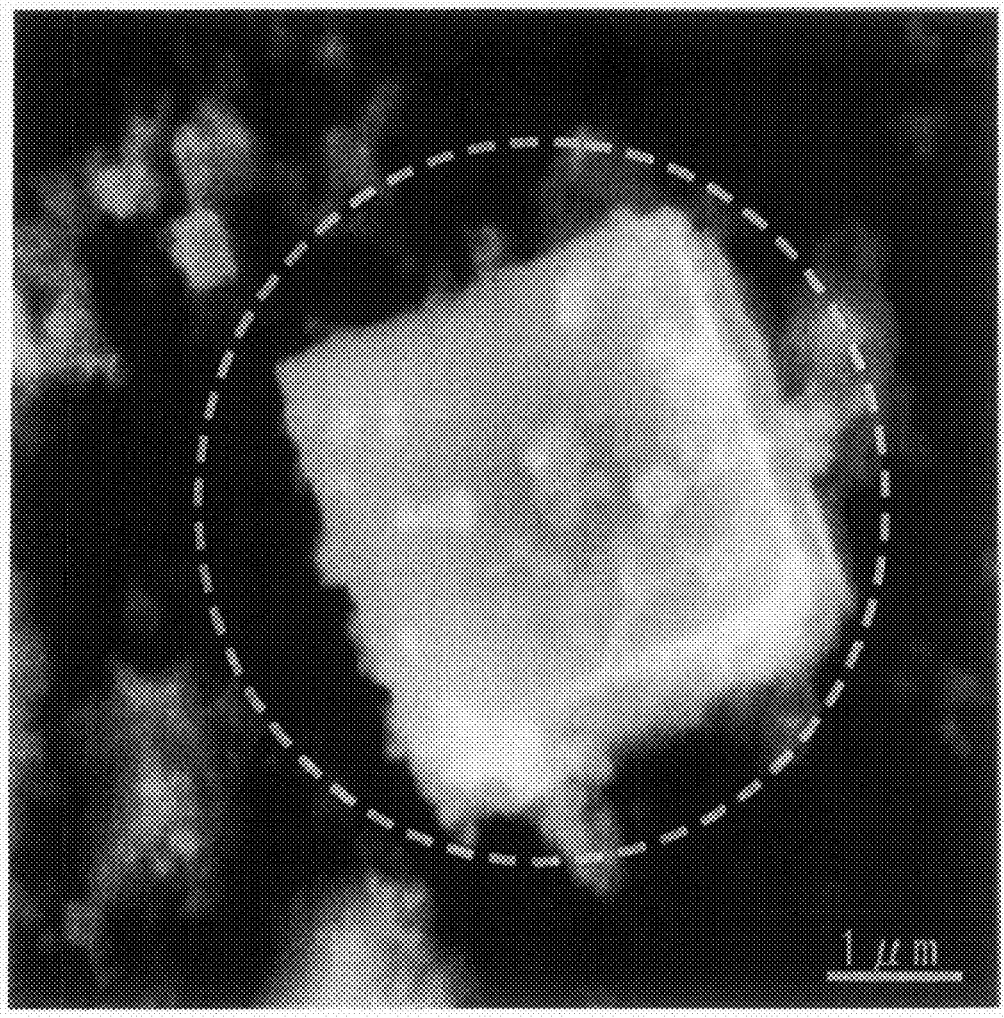
FIG. 6 is a SEM photograph of the magnesium oxide single-crystal having a cubic single-crystal structure.
Figure 7:
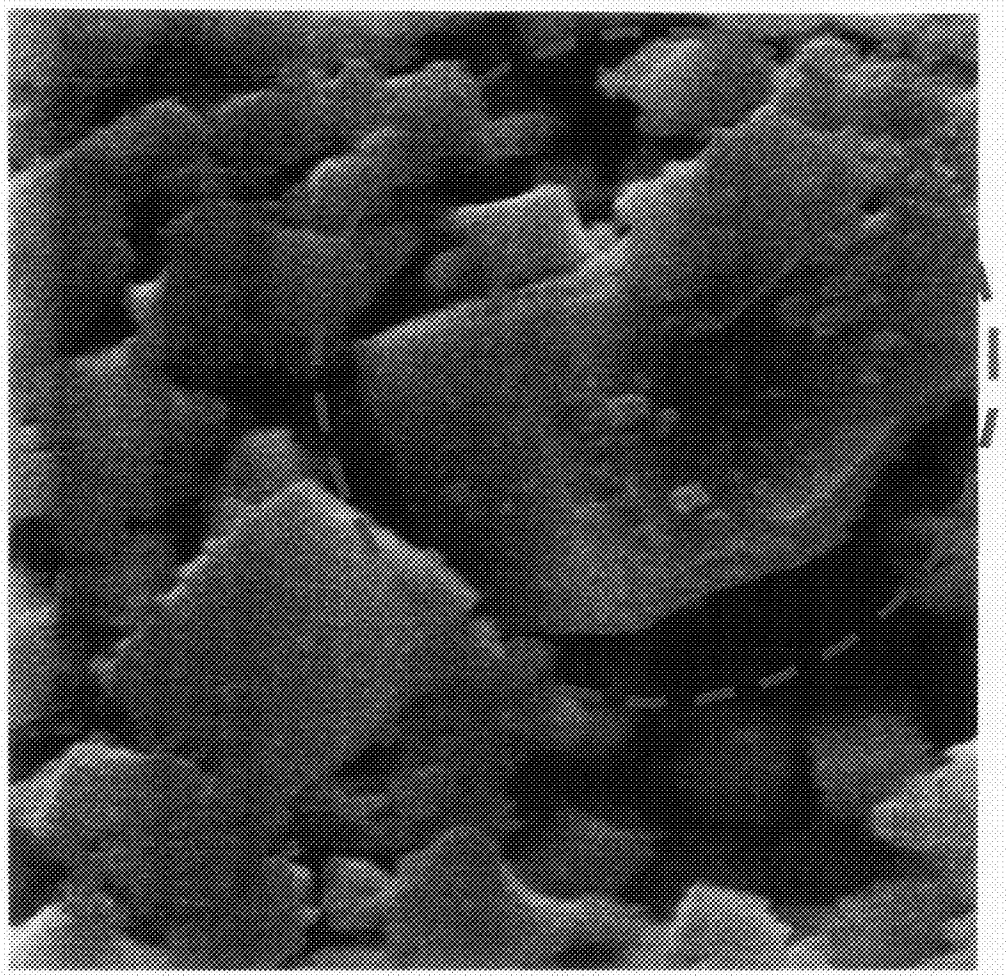
FIG. 7 is a SEM photograph of the magnesium oxide single-crystal having a cubic polycrystal structure.

Examples of the MgO crystal, used as materials for forming the crystalline MgO layer 5 and that have a crystalline structure causing a CL emission having a peak within a wavelength range of 200 nm to 300 nm (more specifically, of 230 nm to 250 nm, around 235 nm) by being excited by an electron beam, include a magnesium single-crystal which is obtained by performing vapor-phase oxidization on magnesium steam generated by heating magnesium (this magnesium single-crystal is hereinafter referred to as "vapor-phase MgO single-crystal"). Examples of the vapor-phase MgO single-crystal include an MgO single-crystal having a cubic single-crystal structure as illustrated in the SEM photograph in FIG. 6, and an MgO single-crystal having a structure of cubic crystal fitted to each other (i.e. a cubic polycrystal structure) as illustrated in the SEM photograph in FIG. 7.

The vapor-phase MgO single-crystal contributes to an improvement in the discharge characteristics such as a reduction in discharge delay as described later.

As compared with magnesium oxide obtained by other methods, the vapor-phase MgO single-crystal has the features of being of a high purity, taking a microscopic particle form, causing less particle agglomeration, and the like.

The vapor-phase MgO single-crystal used in the embodiment example has an average particle diameter of 500 or more angstroms (preferably, 2000 or more angstroms) based on a measurement using the BET method.

Note that the synthesis of the vapor-phase MgO single-crystal is described in "Synthesis of magnesia powder using a vapor phase method and its properties" (Zairyou (Materials) Vol. 36, No. 410, pp. 1157-1161, November 1987), and the like.

The crystalline MgO layer 5 is formed by the affixation of the vapor-phase MgO single-crystal by use of a spraying technique, electrostatic coating technique or the like, as described earlier.

In the above-mentioned PDP, a reset discharge, an address discharge and a sustaining discharge for generating an image are produced in the discharge cell C.

The PDP of the above mentioned structure is significantly improved in its discharge delay characteristics by providing a crystalline MgO layer 5 including the vapor-phase MgO single-crystal as compared with a conventional PDP having only a thin-film MgO layer.

When the reset discharge is initiated in the discharge cells C prior to the address discharge, the priming effect caused by the reset discharge is maintained for a long duration as a result of the crystalline MgO layer 5 formed in the discharge cells C, leading to a fast response of the address discharge.

Figure 8:
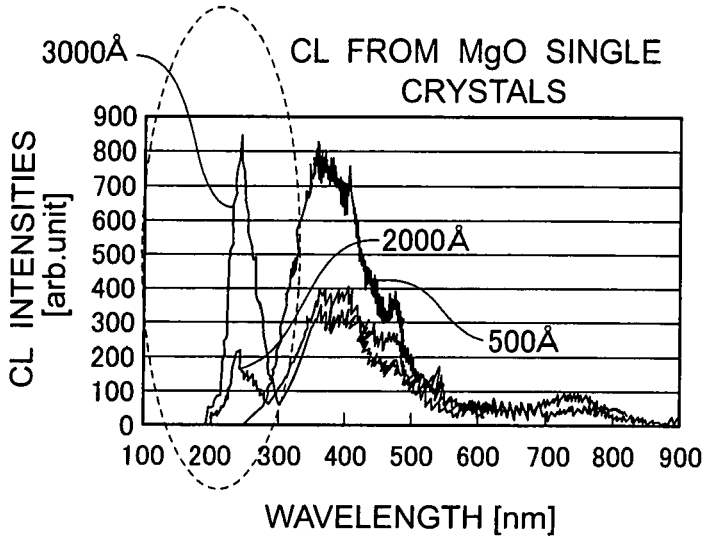
FIG. 8 is a graph showing the relationship between the particle size of a magnesium oxide single-crystal and the wavelengths of a CL emission in the embodiment example.
Figure 9:
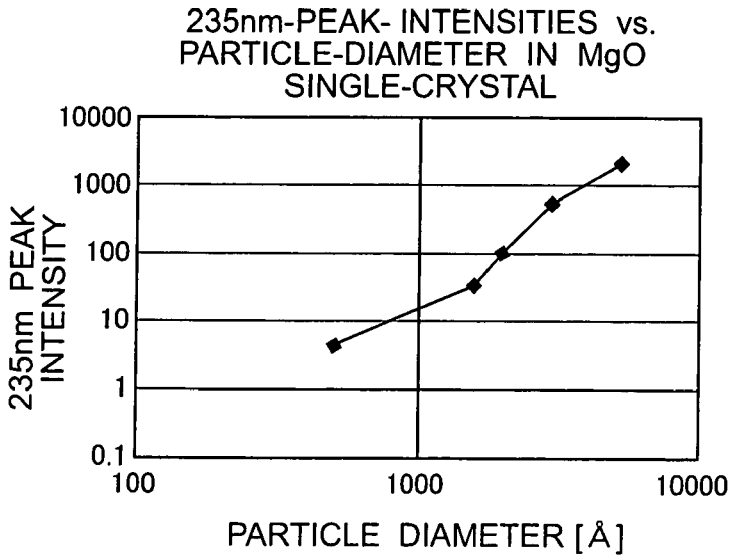
FIG. 9 is a graph showing the relationship between the particle size of a magnesium oxide single-crystal and the intensities of a CL emission at 235 nm in the embodiment example.

More specifically, the crystalline MgO layer 5 is formed of the vapor-phase MgO single-crystal as described earlier, and the vapor-phase MgO single-crystal has a crystalline structure that causes a CL emission having a peak within a wavelength range from 200 nm to 300 nm (more specifically, from 230 nm to 250 nm, around 235 nm) from the large-particle-diameter vapor-phase MgO single-crystal included in the crystalline MgO layer 5 in addition to a CL emission having a peak wavelength from 300 nm to 400 nm, as shown in FIGS. 8 and 9.

Figure 10:
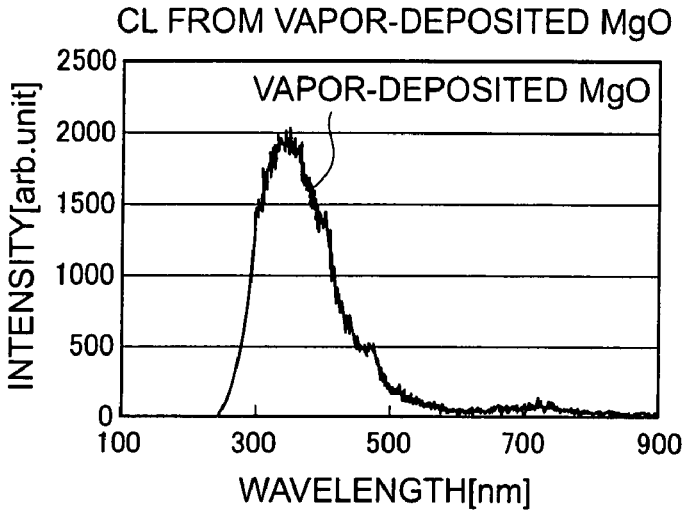
FIG. 10 is a graph showing the state of the wavelength of a CL emission from a magnesium oxide layer formed by vapor deposition.

As shown in FIG. 10, a CL emission with a peak wavelength of 235 nm is not excited from an MgO layer formed typically by vapor deposition (the thin-film MgO layer 4 in the embodiment example), but only a CL emission having a peak wavelength of between 300 nm and 400 nm is excited.

In addition, as seen from FIGS. 8 and 9, the greater the particle diameter of the vapor-phase MgO single-crystal, the stronger the peak intensity of the CL emission having a peak within the wavelength range from 200 nm to 300 nm (more specifically, from 230 nm to 250 nm, around 235 nm).

It is estimated that the presence of the property causing a CL emission having a peak wavelength of between 200 nm and 300 nm will bring about a further improvement in the discharge characteristics (a reduction in discharge delay, an increase in the discharge probability).

More specifically, the estimated reason why the crystalline MgO layer 5 causes the improvement in the discharge characteristics is because the vapor-phase MgO single-crystal has a crystalline structure causing the CL emission having a peak within the wavelength range from 200 nm to 300 nm (particularly, from 230 nm to 250 nm, around 235 nm) has an energy level corresponding to the peak wavelength, so that the energy level enables the trapping of electrons for a long time (some msec. or more), and the trapped electrons are extracted by an electric field so as to serve as the primary electrons required for starting a discharge.

Also, because of the correlation between the intensity of the CL emission and the particle diameter of the vapor-phase MgO single-crystal, the stronger the intensity of the CL emission having a peak within the wavelength range of from 200 nm to 300 nm (more particularly, from 230 nm to 250 nm, around 235 nm), the greater the effect of improving the discharge characteristics caused by the vapor-phase MgO single-crystal.

In other words, in order to form a vapor-phase MgO single-crystal with a large particle diameter, an increase in the heating temperature for generating magnesium vapor is required. This requirement increases the length of the flame with which magnesium and oxygen react, in turn increasing the temperature difference between the flame and the surrounding ambience. Thus, it is conceivable that the larger the particle diameter of the vapor-phase MgO single-crystal, the greater the number of energy levels occurring in correspondence with the peak wavelengths (e.g. within a range of from 230 nm to 250 nm, around 235 nm) of the CL emission as described earlier.

It is further estimated that in the case of a vapor-phase MgO single-crystal of a cubic polycrystal structure, many crystal-plane defects occur, and the presence of energy levels arising from these crystal-plane defects contributes to an improvement in discharge probability.

The BET specific surface area (s) is measured by a nitrogen adsorption method. From the measured value, the particle diameter ($D_{BET}$) of the vapor-phase MgO single-crystal forming the crystalline MgO layer 5 is calculated by the following equation.

$$D_{BET}=A/s\times\rho$$

where A: shape count (A=6)

ρ: real density of magnesium

Figure 11:
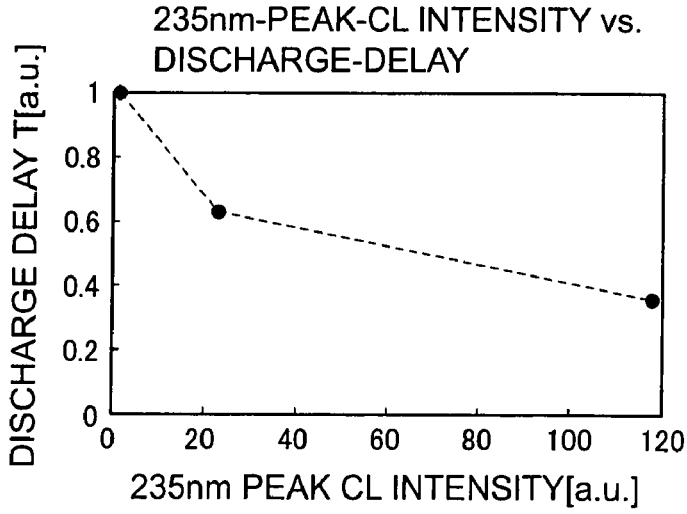
FIG. 11 is a graph showing the relationship between the discharge delay and the peak intensities of a CL emission at 235 nm from the magnesium oxide single-crystal.

FIG. 11 is a graph showing the correlation between the CL emission intensities and the discharge delay.

It is seen from FIG. 11 that the display delay in the PDP is shortened by the 235-nm CL emission property of the crystalline MgO layer 5, and further as the intensity of the 235-nm CL emission increases, the discharge delay time is shortened.

Figure 12:
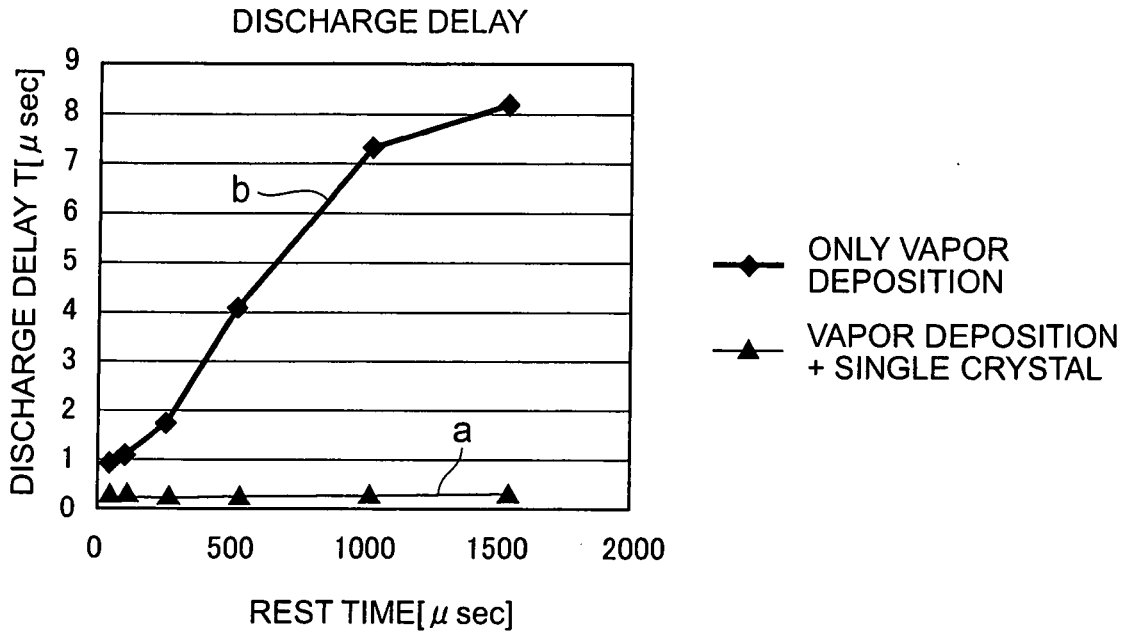
FIG. 12 is a graph showing a comparison of the discharge delay characteristics between the case when the protective layer is constituted only of the magnesium oxide layer formed by vapor deposition and that when the protective layer has a double layer structure made up of a crystalline magnesium layer and a thin-film magnesium layer formed by vapor deposition.

FIG. 12 shows a comparison of the discharge delay characteristics between the case of the PDP having the double-layer structure of the thin-film MgO layer 4 and the crystalline MgO layer 5 as described earlier (Graph a), and the case of a conventional PDP having only an MgO layer formed by vapor deposition (Graph b).

As seen from FIG. 12, the double-layer structure of the thin-film MgO layer 4 and the crystalline MgO layer 5 of the PDP offers a significant improvement in the discharge delay characteristics of the PDP over that of a conventional PDP having only a thin-film MgO layer formed by vapor deposition.

As described hitherto, in addition to the conventional type of thin-film MgO layer 4 formed by vapor deposition or the like, the crystalline MgO layer 5, which includes MgO crystal that has a crystalline structure causing a CL emission having a peak within a wavelength range from 200 nm to 300 nm upon excitation by an electron beam, is formed, whereby the PDP structured according to the present invention enables an improvement in the discharge characteristics such as those relating to the discharge delay, and thus can show a satisfactory level of discharge characteristics.

The MgO crystal used for forming the crystalline MgO layer 5 has an average particle diameter of 500 or more angstroms based on a measurement using the BET method, desirably, within a range of from 2000 angstroms to 4000 angstroms.

As described earlier, the crystalline MgO layer 5 is not necessarily required to overlie the entire face of the thin-film MgO layer 4, and may be partially formed by a patterning technique, for example, on a portion of the thin-film MgO layer 4 facing the transparent electrodes Xa and Ya of the row electrodes X and Y or conversely on the portion other than the portion facing the transparent electrodes Xa and Ya.

When the crystalline MgO layer 5 is partially formed, the area ratio of the crystalline MgO layer 5 to the thin-film MgO layer 4 is set at 0.1% to 85%, for example.

Figure 13:
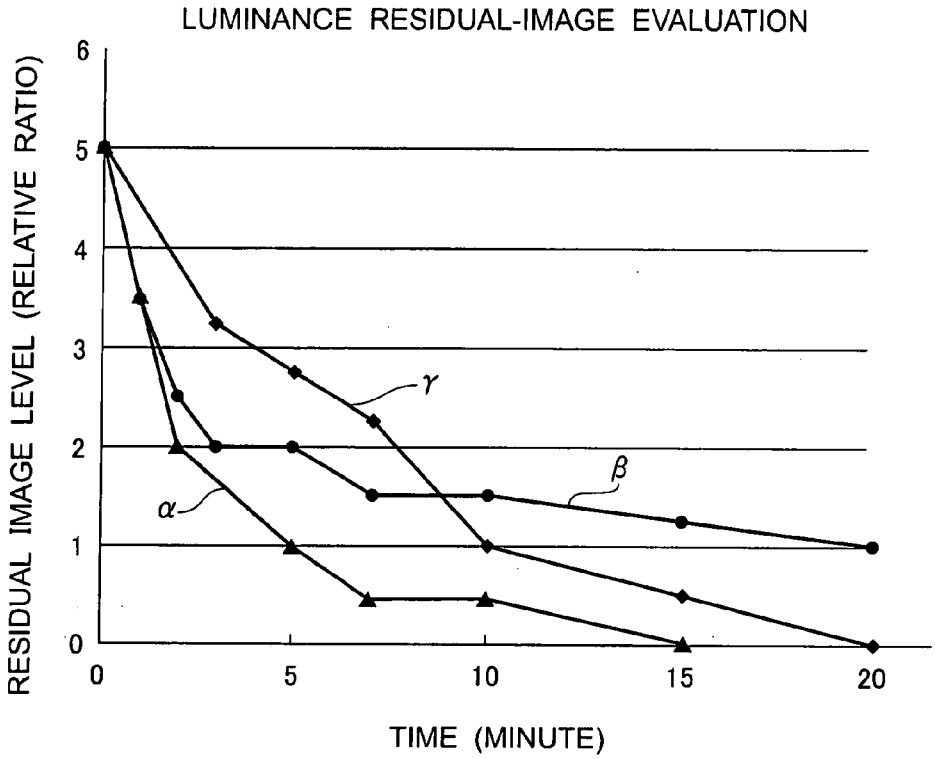
FIG. 13 is a graph showing a comparison of luminance residual image evaluations.

FIG. 13 is a graph showing the comparison between the luminance residual-image characteristics in the panel surface of the foregoing PDP when operated and those of a conventional PDP.

In FIG. 13, graph α shows the evaluation of the luminance residual image of the PDP having the foregoing structure (specifically, the protective layer has the thin-film MgO layer 4 and the crystalline MgO layer 5 (in this case, the vapor-phase MgO crystal is sprayed on the thin-film MgO layer 4 so that the panel transmissivity reaches 85%) and the red phosphor layer 9 is formed of the mixed red phosphor).

Graph β shows the evaluation of the luminance residual image of a PDP in which the protective layer has the thin-film MgO layer and the crystalline MgO layer as in the case of the PDP with the above structure and a red phosphor layer is formed of only one kind of phosphor, for example, of (Y, Gd)$BO_3$:Eu alone, without the phos-vana (phosphorus-vanadium) system red phosphor as in the case of a conventional PDP.

Graph γ shows the evaluation of the luminance residual image of a conventional PDP in which the protective layer has only the thin-film MgO layer and a red phosphor layer is formed of only one kind of a phosphor, for example, of (Y, Gd)$BO_3$:Eu.

In the case of each of the graphs of the luminance residual image evaluation in FIG. 13, the luminance of the panel surface (full white display) before image generation (before visible light emission) is used as a reference value, and is defined as level zero. Then, after an image has been generated (after visible light emission), the panel surface is returned to the display status before image generation (full white display) and the luminance at this point is measured. The relative ratio of the luminance measured value of the panel surface in this return status to the reference value is defined as the residual image level. This residual image level is represented by the vertical axis in FIG. 13, and the time that has elapsed after the image has been generated is represented by the horizontal axis in FIG. 13.

In FIG. 13, as seen from graph α, in the PDP having the crystalline MgO layer 5 and the phosphor layer 9 formed of the mixed red phosphor, the residual image level drops to 0.5 after a lapse of 10 minutes after the visible light emission for the image, and then returns to level zero after a lapse of 15 minutes.

In the PDP having the crystalline MgO layer as in the case of the PDP with the above structure and a red phosphor layer formed of only one kind of phosphor without a phos-vana (phosphorus-vanadium) system red phosphor, as seen from graph β, the residual image level drops to 1.5 after a lapse of 10 minutes after the visible light emission for the image, but after a lapse of 20 minutes it only returns to residual image level 1 at the lowest.

However, in the conventional PDP having no crystalline MgO layer and having a red phosphor layer formed of only one kind of a phosphor without a phos-vana (phosphorus-vanadium) system red phosphor, as seen from graph γ, the residual image level drops to 1 after a lapse of 10 minutes after the visible light emission for the image, and returns to level zero after a lapse of 20 minutes.

It is seen from FIG. 13 that, in the PDP provided with the crystalline MgO layer, when the red phosphor layer is formed of a conventional phosphor (in the case of graph β), because of the provision of the crystalline MgO layer, the residual image level in the case of graph β becomes lower than in the case of the conventional PDP (the case of graph γ) and the luminance residual-image characteristics of the panel are improved in the early stage of the evaluation of luminance residue until a lapse of about nine minutes after the visible light emission for the image, and thereafter the residual image level returns to the initial luminance (level zero) at a snail's pace, resulting in degradation in the luminance residual-image characteristics.

In contrast, in the PDP having the red phosphor layer formed of the mixed red phosphor as described above (the PDP of graph α), even when the crystalline MgO layer is provided in the PDP, the luminance residual-image characteristics are improved in the early stages of the evaluation and also the time required for returning to the initial luminance (level zero) is the shortest of all the cases. In consequence, it is seen that the luminance voltage residual-image characteristics and panel life are significantly improved.

Figures 14, 15:
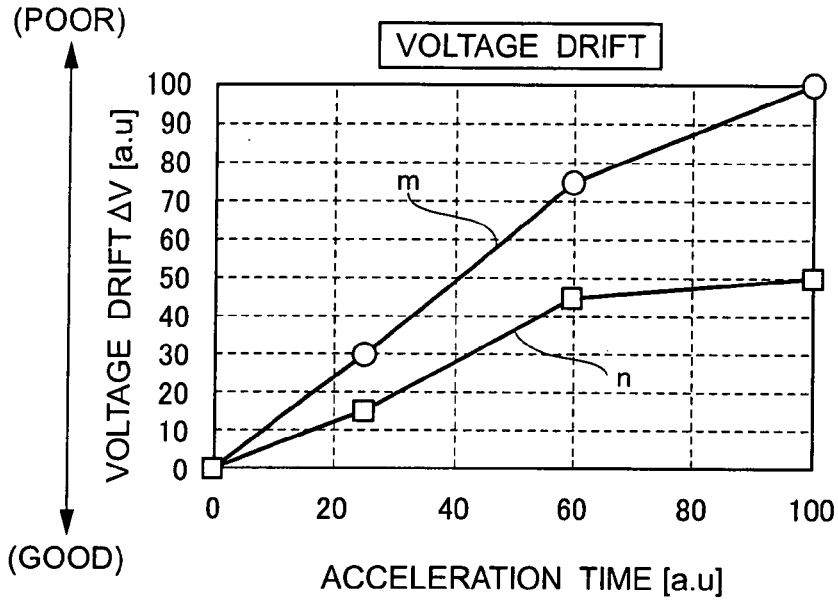
FIG. 14 is a graph showing a comparison of the voltage drift between the PDP according to the embodiment of the present invention and a conventional PDP.
FIG. 15 is a table showing a comparison of the voltage drift.

FIGS. 14 and 15 are a graph and a table showing a comparison between the voltage drift when the foregoing PDP is operated and the voltage drift when a conventional PDP is operated.

In FIG. 14, graph m shows the voltage drift in a PDP having a conventional red phosphor layer formed of only one kind of red phosphor (Y, Gd)$BO_3$:Eu. Graph n shows the voltage drift in the PDP having a red phosphor layer formed of a mixed red phosphor of 50 wt % of a red phosphor (Y, Gd)$BO_3$:Eu and 50 wt % of a phos-vana system red phosphor Y(V, P)$O_4$:Eu.

In FIGS. 14 and 15, the acceleration time indicates the time period during which moving images are continuously displayed, the voltage drift ΔV indicates the difference between the lower limit value of a discharge sustaining voltage at the time when the acceleration time is zero and the lower limit value of the discharge sustaining voltage at the expiration of a predetermined acceleration time.

Both the acceleration time and the voltage drift ΔV are shown with absolute values.

It is seen from FIGS. 14 and 15 that the PDP having a red phosphor layer formed of a mixed red phosphor including a phos-vana system red phosphor has about twice the voltage life of the panel of a PDP having a red phosphor layer formed of a conventional red phosphor.

Figures 16, 17:
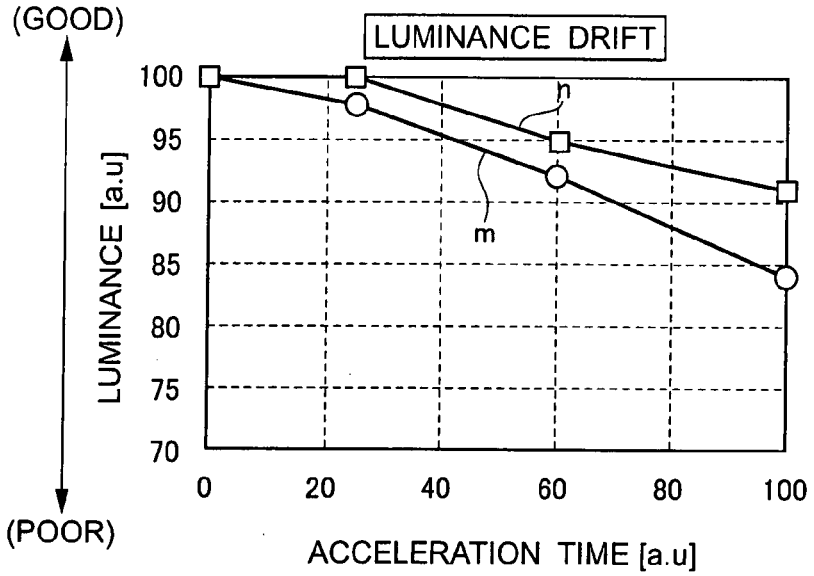
FIG. 16 is a graph showing a comparison of the luminance drift between the PDP according to the embodiment of the present invention and a conventional PDP.
FIG. 17 is a table showing a comparison of the luminance drift.

FIGS. 16 and 17 are a graph and a table showing a comparison between the luminance drift when the foregoing PDP is driven and that when a conventional PDP is driven.

As in the case of FIG. 14, in FIG. 16, graph m shows the luminance drift in a PDP having a conventional red phosphor layer and graph n shows the luminance drift in a PDP having the red phosphor layer formed of the mixed red phosphor.

In FIGS. 16 and 17, the luminance is shown with an absolute value and the acceleration time is the same as that shown in FIGS. 14 and 15.

It is seen from FIGS. 16 and 17 that the PDP having a red phosphor layer formed of a mixed red phosphor including a phos-vana system red phosphor has about twice the luminance life of the panel of a PDP having a red phosphor layer formed of a conventional red phosphor.

Figures 18, 19:
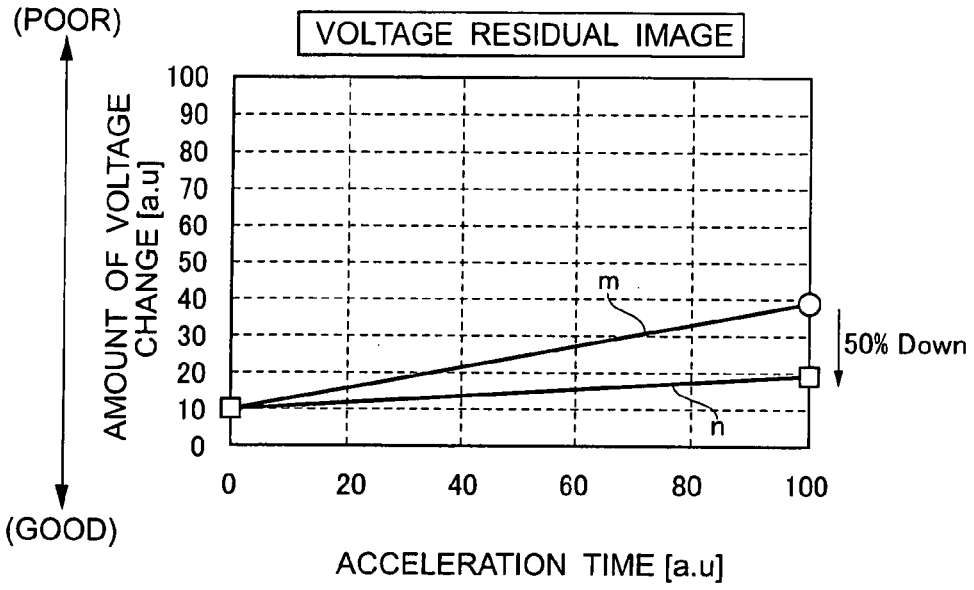
FIG. 18 is a graph showing a comparison of the voltage residual image between the PDP according to the embodiment of the present invention and a conventional PDP.
FIG. 19 is a table showing a comparison of the voltage residual image.

FIGS. 18 and 19 are a graph and a table showing a comparison between the voltage residual image when the foregoing PDP is driven and that when a conventional PDP is driven.

As in the case in FIG. 14, in FIG. 18, graph m shows the voltage residual image in a PDP having a conventional red phosphor layer and graph n shows the voltage residual image in the PDP having a red phosphor layer formed of the mixed red phosphor.

The voltage residual image is here defined as the quantitative evaluation of a reduction in the voltage margin (voltage change) caused by the visible light emission for a fixed display picture.

The acceleration time is the same as that shown in FIGS. 16 and 17.

FIGS. 18 and 19 show that the PDP having the red phosphor layer formed of the mixed red phosphor including the phos-vana system red phosphor is increasingly improved in the voltage residual image with the increase in the acceleration time as compared with that in the PDP having a red phosphor layer formed of a conventional red phosphor. For example, when the acceleration time is 100, the luminance residual image is reduced by 50%.

Next, a description will be given of the reasons why, even when a PDP is provided with the crystalline MgO layer, the provision of a red phosphor layer formed of the mixed red phosphor offers considerable improvements in the luminance voltage residual-image characteristics and the panel life as compared with the conventional PDP.

Figure 20:
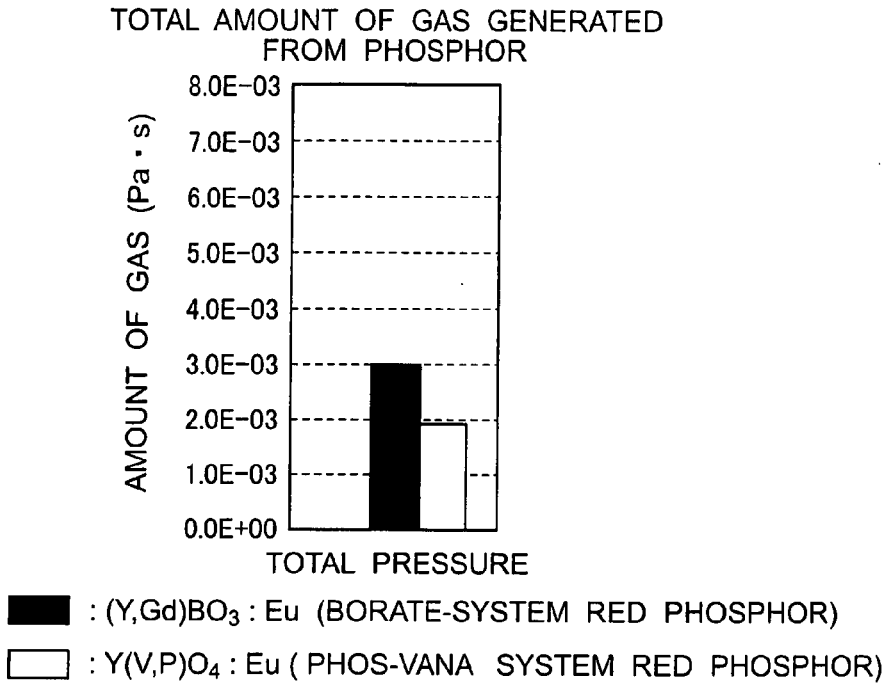
FIG. 20 is a graph showing a comparison of the total amount of gas generated from phosphor.
Figure 21:
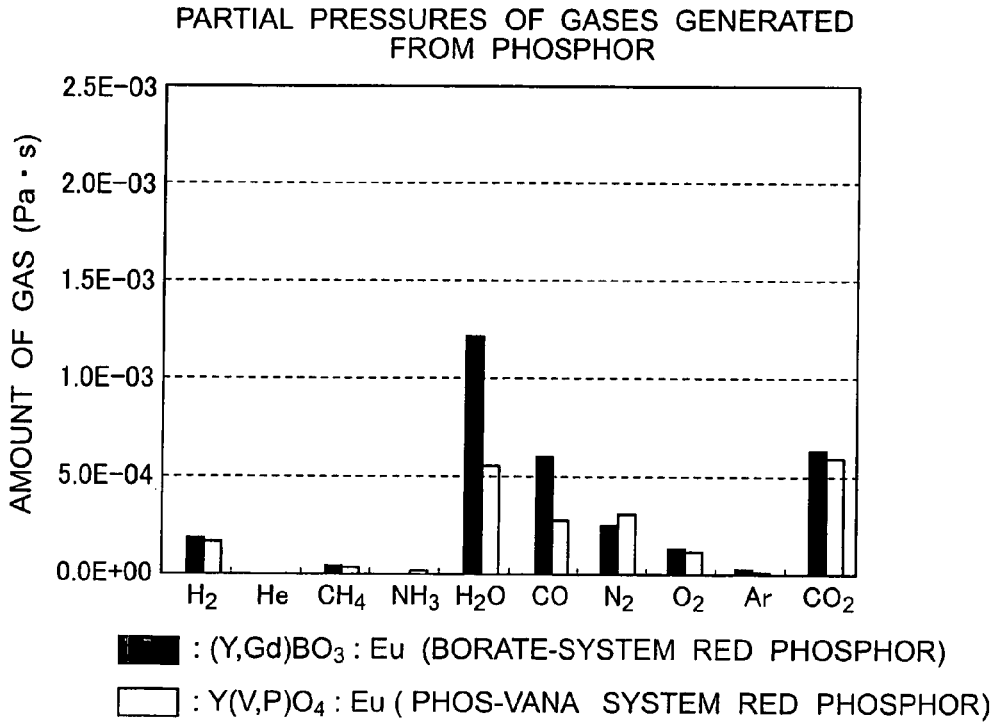
FIG. 21 is a graph showing a comparison of the partial pressures of gases generated from phosphor.

FIG. 20 shows the total amount of gases generated from (Y, Gd)$BO_3$:Eu of a borate-system red phosphor and Y(V, P)$O_4$:Eu of a phos-vana system red phosphor by a plasma discharge in the discharge cell C, and FIG. 21 shows a partial pressure of each of the gases included in the gases thus respectively generated.

In FIGS. 20 and 21, the black graph indicates the amount of gas of (Y, Gd)$BO_3$:Eu of the borate-system red phosphor, and the white graph indicates the amount of gas of Y(V, P)$O_4$:Eu of the phos-vana system red phosphor. As seen from FIGS. 20 and 21, Y(V, P)$O_4$:Eu of the phos-vana system red phosphor generates a lower total amount of gas than (Y, Gd)$BO_3$:Eu of the borate-system red phosphor, and also shows a decrease in the amounts of carbonization gas (CO gas) and reduction gas ($H_2O$ gas) generated.

For this reason, when the red phosphor layer is formed of a mixed red phosphor made by mixing together the first red phosphor ((Y, Gd)$BO_3$:Eu of a borate-system red phosphor) and the second red phosphor (Y(V, P)$O_4$:Eu of a phos-vana system red phosphor), the amount of gas generated by the plasma discharge in the discharge cell C, in particular, the gas amount of CO gas and $H_2O$ gas, is reduced as compared with that in the case of the conventional red phosphor layer formed of only (Y, Gd)$BO_3$:Eu of a borate-system red phosphor, thus minimizing the effect on the magnesium oxide forming the protective layer having the function of protecting the dielectric layer and the function of emitting secondary electrons. In consequence, it is thought that, even when the protective layer has a crystalline MgO layer having a high degree of the function of emitting secondary electrons, the $\gamma$ characteristics of the panel are not deteriorated.

As described above, with the foregoing PDP, the red phosphor layer 9 is formed of the mixed red phosphor made by mixing together the first red phosphor ((Y, Gd)$BO_3$:Eu of a borate-system red phosphor) and the second red phosphor (Y(V, P)$O_4$:Eu of a phos-vana system red phosphor). This makes it possible to significantly improve the luminance voltage residual-image characteristics and the panel life of the PDP equipped with the protective layer having the crystalline MgO layer 5 with a high degree of the secondary-electron-emission function and including the vapor-phase MgO single-crystal, as compared with the conventional PDP.

The foregoing has described the example when the present invention applies to a reflection type AC PDP having a front glass substrate on which row electrode pairs are formed and covered with a dielectric layer and a back glass substrate on which phosphor layers and column electrodes are formed. However, the present invention is applicable to various types of PDPs, such as a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the respective intersections between row electrode pairs and column electrodes; a two-electrode AC PDP having discharge cells formed in the discharge space in positions corresponding to the respective intersections between row electrodes and column electrodes.

Further, the foregoing has described the example when the crystalline MgO layer 5 is formed through affixation by use of a spraying technique, an electrostatic coating technique or the like. However, the crystalline MgO layer 5 may be formed through the application of a coating of a paste including an MgO crystal powder by use of a screen printing technique, an offset printing technique, a dispenser technique, an inkjet technique, a roll-coating technique or the like. Alternatively, a coating of a paste including an MgO crystal may be applied on a support film and then be dried to go into film form. Then, the resulting film may be laminated on the thin-film MgO layer.

Still further, the foregoing has described the example when the crystalline MgO layer 5 includes an MgO crystal. However, it is possible to provide the same effects even if the MgO crystal is simply sprayed on the dielectric layer and does not form a layer.

The gas discharge display apparatus of the aforementioned embodiment is based on an embodiment with the basic idea that the protective layer for the dielectric layer which overlies the row electrode pairs provided between a pair of substrates facing across the discharge space includes a magnesium oxide crystal that causes a cathode-luminescence emission having a peak within a wavelength range of 200 nm to 300 nm upon excitation by electron beams, and at least one phosphor layer of the red, green and blue colored phosphor layers which generate visible light by being excited by vacuum ultraviolet light, for example, the red phosphor layer, includes a mixed phosphor made by combining a first phosphor of, for example, (Y, Gd)$BO_3$:Eu or the like of a borate-system red phosphor and a second phosphor of, for example, Y(V, P)$O_4$:Eu or the like of a phos-vana system red phosphor which generates lower amounts of reduction gas and carbonization gas than the first phosphor.

In the gas discharge display apparatus constituting the embodiment of this basic idea, for example, the red phosphor layer from among the phosphor layers is formed of the mixed phosphor of the first phosphor and the second phosphor which generates lower amounts of reduction gas and carbonization gas than the first phosphor. Thereby, even when the protective layer covering the dielectric layer of the gas discharge display apparatus includes an MgO crystal of a high degree of the secondary-electron-emission function, the amount of gas generated when the phosphor layer is excited by the vacuum ultraviolet light, in particular, the amounts of carbonization gas (CO gas) and reduction gas ($H_2O$ gas), are reduced as compared with a conventional red phosphor layer. Thus, the effects on the magnesium oxide forming the protective layer are minimized so as to maintain the $\gamma$ characteristics of the panel. In consequence, it is possible to improve the luminance voltage residual-image characteristics and the panel life of the gas discharge display apparatus to a significantly higher level than heretofore.

The terms and description used herein are set forth by way of illustration only and are not meant as limitations. Those skilled in the art will recognize that numerous variations are possible within the spirit and scope of the invention as defined in the following claims.

What is claimed is:

1. A gas discharge display apparatus comprising a pair of substrates facing each other across a discharge space; row electrode pairs and column electrodes which are placed between the pair of substrates, each row electrode pair and each column electrode being positioned at distance from each other and extending in directions at right angles to each other to form unit light emission areas in positions corresponding to the intersections in the discharge space; a dielectric layer overlying the row electrode pairs; a protective layer overlying the dielectric layer and facing the unit light emission areas; and red, green and blue colored phosphor layers that generate visible light by being excited by vacuum ultraviolet light, wherein the discharge space is filled with a discharge gas, the protective layer includes a magnesium oxide crystal that has a crystalline structure causing a cathode-luminescence emission having a peak within a wavelength range of 200 nm to 300 nm upon excitation by electron beams, and at least one phosphor layer of the red, green and blue colored phosphor layers includes a phosphor made by mixing together a first phosphor and a second phosphor generating lower amounts of reduction gas and carbonization gas than that generated by the first phosphor.

2. The gas discharge display apparatus according to claim 1, wherein the at least one phosphor layer is the red colored phosphor layer.

3. The gas discharge display apparatus according to claim 2, wherein the first phosphor included in the red colored phosphor layer is a borate-system red phosphor and the second phosphor included therein is a phosphorus-vanadium system red phosphor.

4. The gas discharge display apparatus according to claim 3, wherein the first phosphor is (Y, Gd)$BO_3$:Eu and the second phosphor is Y(V, P)$O_4$:Eu.

5. The gas discharge display apparatus according to claim 2, wherein the mixed phosphor included in the red phosphor layer includes 20 wt % to 80 wt % of the second phosphor.

6. The gas discharge display apparatus according to claim 1, wherein the protective layer comprises a thin-film magnesium oxide layer deposited by vapor deposition or by sputtering, and a crystalline magnesium oxide layer including a magnesium oxide crystal and deposited and laminated on the thin-film magnesium oxide layer.

7. The gas discharge display apparatus according to claim 1, wherein the magnesium oxide crystal is a magnesium oxide single-crystal produced by a vapor-phase oxidization technique.

8. The gas discharge display apparatus according to claim 1, wherein the magnesium oxide crystal has a crystalline structure causing a cathode-luminescence emission having a peak within a wavelength range of 230 nm to 250 nm.

9. The gas discharge display apparatus according to claim 1, wherein the magnesium oxide crystal has a particle diameter of 2000 or more angstroms.

10. The gas discharge display apparatus according to claim 1, wherein the discharge gas includes 10% or more xenon by volume.

11. The gas discharge display apparatus according to claim 1, wherein the dielectric layer includes a leadless glass material having a relative dielectric constant of 8 or less.

* * * * *